United States Patent [19]

Jacobsen et al.

[11] 4,425,843

[45] Jan. 17, 1984

[54] REMOVABLE FACEPLATE COMPACTOR RAM

[75] Inventors: David T. Jacobsen; Jerome P. Klopfenstein, both of Battle Creek, Mich.

[73] Assignee: General Foods Corporation, White Plains, N.Y.

[21] Appl. No.: 344,856

[22] Filed: Feb. 1, 1982

[51] Int. Cl.[3] ..... B30B 15/06

[52] U.S. Cl. ..... 100/229 A; 100/295; 403/322; 403/327; 403/330

[58] Field of Search ..... 100/229 A, 295; 403/322, 327, 330

[56] References Cited

U.S. PATENT DOCUMENTS

| | | | |
|---|---|---|---|
| 3,129,657 | 4/1964 | Farley | 100/229 A |
| 3,229,618 | 1/1966 | O'Connor | 100/229 A |
| 3,511,176 | 5/1970 | Szaj | 100/229 A |
| 3,880,072 | 4/1975 | Ord | 100/229 A |

FOREIGN PATENT DOCUMENTS

| | | | |
|---|---|---|---|
| 53-1974 | 1/1978 | Japan | 100/229 A |

*Primary Examiner*—Billy J. Wilhite

*Attorney, Agent, or Firm*—Daniel J. Donovan; Thomas R. Savoie

[57] ABSTRACT

The combination of a storage bin, such as a dumpster container for trash and refuse, with a compactor adapted to convey a solids or particulate material thereto, wherein the compactor incorporates a compactor ram having a face plate releasably latched to the forward or head end of the ram. When the dumpster container is full, the face plate is adapted to be detached from the ram and concurrently fastened to the storage bin to constitute a closure for the material inlet opening of the container so as to prevent spills of trash therefrom.

8 Claims, 9 Drawing Figures

REMOVABLE FACEPLATE COMPACTOR RAM

BACKGROUND OF THE INVENTION

1. Field of the Invention

The present invention relates to the combination of a storage bin, such as a dumpster container for trash and refuse, with a compactor adapted to convey a solids or particulate material thereto, wherein the compactor incorporates a compactor ram having a face plate located at the forward head end of the ram which, when the dumpster container is full, is adapted to be detached from the ram and concurrently fastened to the storage bin to constitute a closure for the material inlet opening of the container so as to prevent spills of trash therefrom.

2. Discussion of the Prior Art

In essence, a problem which is encountered during the removal of full dumpster containers or storage bins for trash and refuse upon withdrawal of an associated compactor, consists of in that some trash will frequently spill out of the inlet opening to the storage bin which communicates with the compactor prior to such inlet opening being sealed of through a suitable cover or hatch on the storage bin. Generally, a compactor associated with a dumpster container or storage bin for trash or other types of solids materials includes a hopper into which such trash or material is fed for conveyance into the compactor in front of a compactor ram which, during its forward stroke will conduct the trash into the dumpster container through an inlet opening which receives the forward or head end of the compactor ram. Usually, the face plate on the compactor ram which displaces the material through the inlet opening into the storage bin or dumpster container is integrally formed with or permanently affixed to the head end of the compactor ram, and remains on the ram upon withdrawal of a full dumpster container from the compactor. This will expose the trash stored in the full dumpster container to the environment at the inlet opening and create unsightly and unsanitary trash spills from the inlet opening of the container prior to such opening being sealed off subsequently by a suitable closure or hatch on the container.

A compactor of the general type employed in the present invention is produced and sold by Heil Corporation as the Heil Huge-Pack Model HP10 compactor, and adapted to be employed in conjunction with a large dumpster container by being connected to or placed in communication with an inlet opening formed along one side of the dumpster container or storage bin. This particular type of prior art compactor does not, however, incorporate a releasable face plate on the head end of the compactor ram which is adapted to be utilized as a seal or closure for the inlet opening of the dumpster container or storage bin when the latter is full and withdrawn from the compactor.

SUMMARY OF THE INVENTION

Accordingly, it is an object of the present invention to provide a compactor of the type described, employed in combination with a dumpster container or bin, which incorporates a removable compactor ram face plate having an integral latch assembly thereon for releasably fastening the face plate to the forward or head end of the compactor ram, with such face plate adapted to enter into the material inlet opening of the associated storage bin or dumpster container for trash, refuse or other types of solids material.

It is a more specific object of the present invention to provide a compactor of the type described in combination with the storage bin or dumpster container, wherein the releasably fastened face plate on the compactor ram, when predeterminately positioned within the opening of the dumpster container is adapted to be detached from the compactor ram and concurrently fastened to the storage bin or container so as to constitute a closure for the opening receiving the material from the compactor.

The foregoing is accomplished pursuant to the invention in that at least one elongated rod member is extended through a through-bore formed in the storage bin for dumpster container in alignment with a conduit provided on the face plate which, when pushed through the conduit on the face plate will cause the latch arrangement fastening the face plate to the compactor ram to disengage, thereby releasing the compactor ram and permitting its retraction within the compactor while concurrently locking the face plate in position to the container within the inlet opening to thereby constitute a seal or closure for the opening. A further similar rod member may be passed through the container or storage bin frame and the face plate in spaced relationship to the above-mentioned elongate rod member to assist in locking the seal or closure across the opening and to prevent pivoting thereof which could cause trash to spill out of the inlet opening of the full dumpster container.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 2:
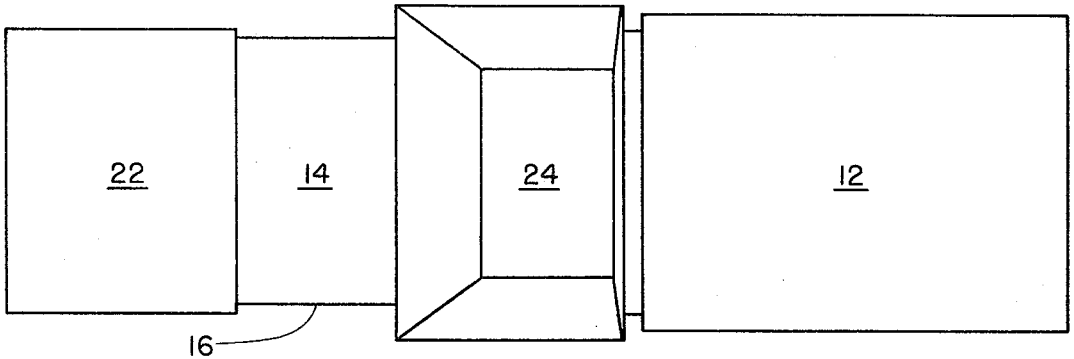
FIG. 2 illustrates a top plan view of the combination of FIG. 1.
Figure 1:
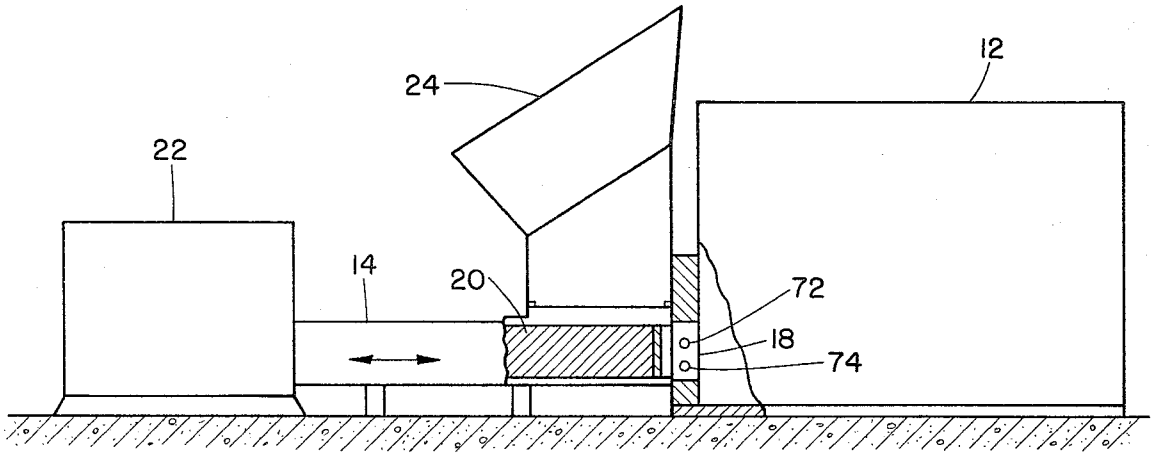
FIG. 1 illustrates a side elevational view of the combination of a storage bin or dumpster container with a compactor incorporating the novel face plate pursuant to the invention on the compactor ram.

Referring now in detail the drawings, particularly FIGS. 1 and 2, there is illustrated an installation 10 which consists of the combination of a storage bin or dumpster container 12 to which there is connected a compactor 14, through linkages or other suitable releasable clamping devices.

The compactor 14 includes a generally rectangular housing 16 having a width extending almost the full width of the dumpster container 12, and which communicates at its outlet end with an inlet opening 18 in the side wall of the container leading into the lower portion of the container 12. The opening 18 is approximately of the same size as the inner dimensions of the compactor housing 16.

Arranged within the housing 16 is a reciprocable compactor ram 20 adapted to be reciprocated to and fro in positive displacement strokes by means of a suitable hydraulic or mechanical drive installation 22 (only schematically disclosed herein).

The top of the compactor housing 16 is open in proximity with the opening 18 leading to the container 12 so as to communicate with an infeed hopper 24 for supplying solids material, refuse or trash which is to be compacted into the compactor housing 16 ahead of the compactor ram 20 which, at that point in time should be in its rearward retracted position towards the drive installation 22.

Figure 4:
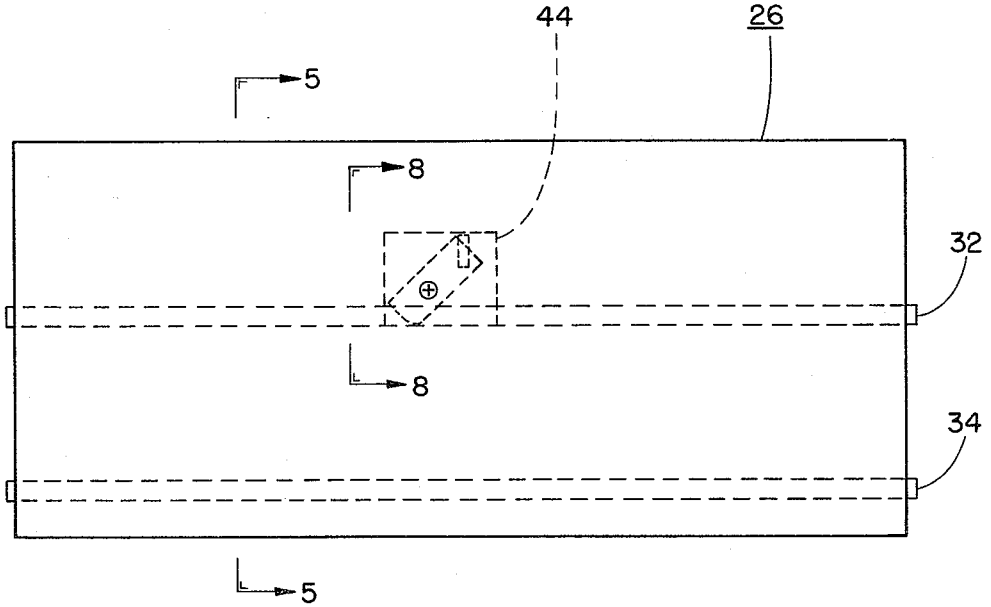
FIG. 4 illustrates a front elevational view of the face plate of FIG. 3.
Figure 3:
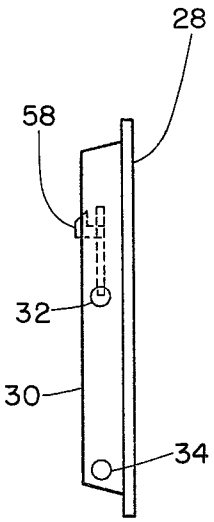
FIG. 3 shows a side elevational view of the face plate.
Figure 5:
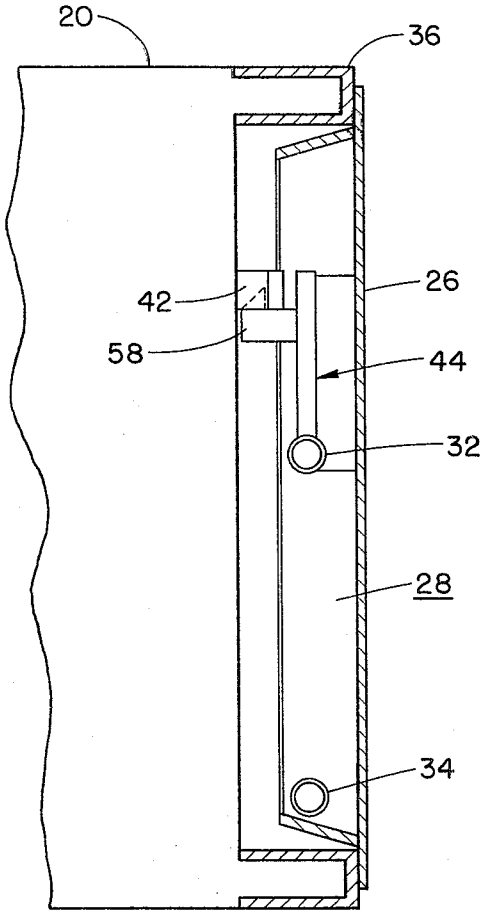
FIG. 5 illustrates a sectional view, on an enlarged scale, taken along line 5—5 in FIG. 4.
Figure 6:
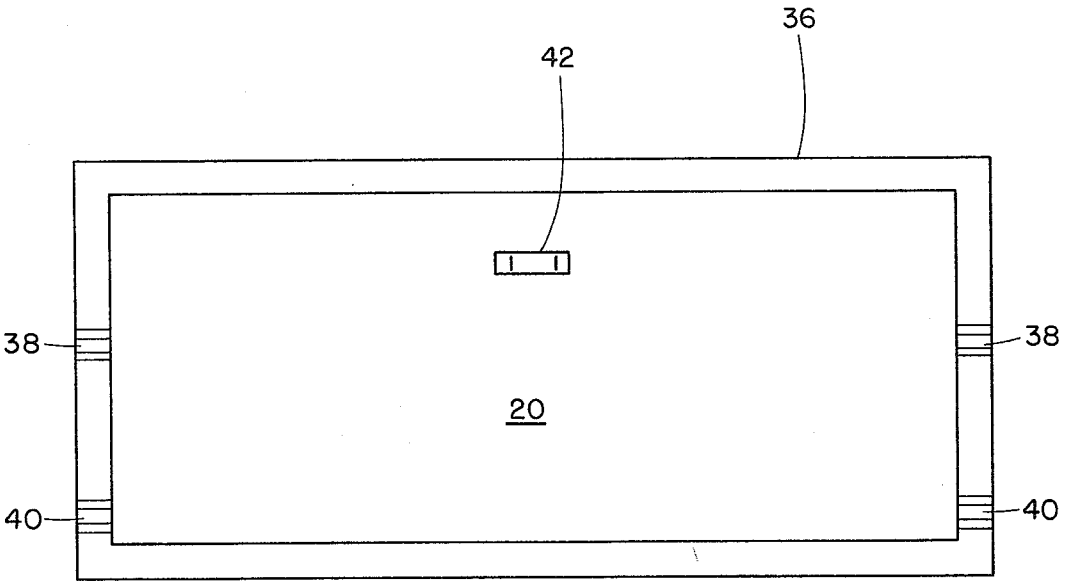
FIG. 6 shows a front elevational view of the guide frame encompassing the face plate.
Figure 7:
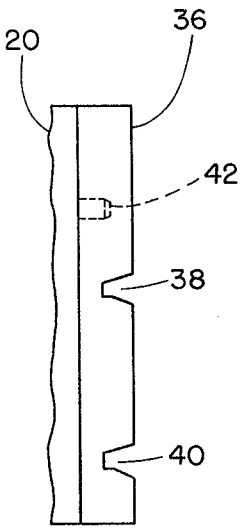
FIG. 7 is a side elevational view of the guide frame of FIG. 6.

The forward or head end of the compactor ram 20 includes a face plate 26 facing towards the opening 18 of the dumpster container 12, as is illustrated in detail in FIGS. 3 and 4 of the drawings. The face plate 26 is generally formed of a steel plate having circumferential dimensions substantially in conformance with the size of the opening 18 leading into the dumpster container 12. As shown in greater particularity in FIG. 5 of the drawings, the face plate 26 includes a generally flat plate 28 having inwardly tapered flanged wall portions 30 which will provide for stiffening support, and also includes pipes or conduits 32 and 34 extending therethrough. Encompassing the face plate 26 is a peripheral guide frame structure 36 permanently affixed to the compactor ram 20, shown in greater detail in FIGS. 6 and 7, which includes generally V-shaped recesses 38 and 40 which are in respective axial alignment with conduits 32 and 34 when assembled with the face plate 26. The guide frame 36 assists in guiding the face plate and the head end of the compactor ram 20 within the compactor housing 16, and also serves to align the face plate 26 in the correct position when latched to the forward or head end of the compactor ram.

The head end of the ram 20 includes a latch bracket 42 which is adapted to be engaged by a latching hook of a latching arrangement 44 mounted on the face plate 26.

Figure 8:
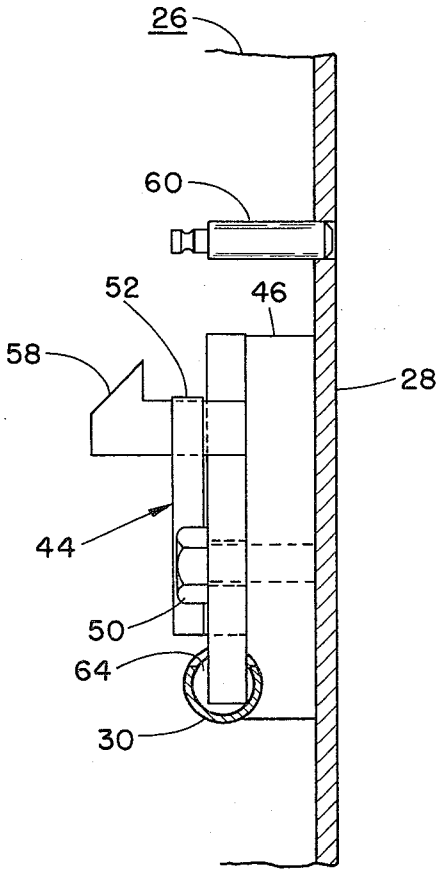
FIG. 8 shows an enlarged scale side elevational view of the latching arrangement for the face plate to the compactor ram, taken along line 8—8 in FIG. 4.
Figure 9:
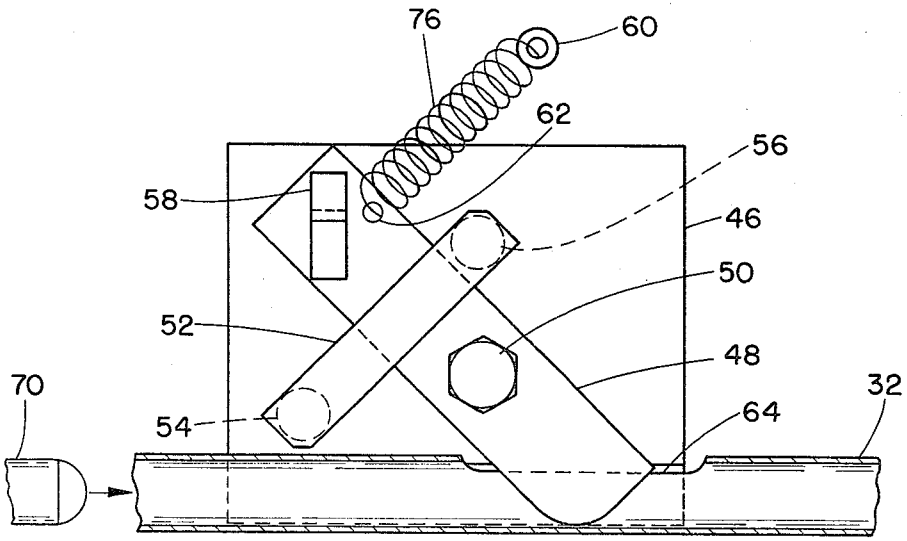
FIG. 9 is a side elevational view of the latching arrangement shown in FIG. 8.

The latching arrangement 44 on the face plate 26, which is adapted to releasably attach the face plate to the compactor ram 20, is described in greater detail in conjunction with FIGS. 8 and 9 of the drawings. The latching arrangement 44 is mounted on the surface of the face plate 26 facing towards the compactor ram 20. The latching arrangement 44 includes a base plate 46 which is bolted or welded onto the face plate 26 or otherwise fastened through suitable fastening means. Arranged on the base plate 46 is a pivot lever 48 which is angled upwardly and which is pivotable about a bolt 50 threaded into the base plate 46. The pivoting range of the lever arm 48 is defined by means of a bracket 52 which is also mounted on the base plate 46, and wherein the motion of lever arm 48 about the bolt 50 is limited between the two end pins 54 and 56 which fasten the bracket 52 to the base plate 46. At the upper end of the pivot lever 48 there is fastened a hook or latch 58 adapted to engage beneath the bracket 42 at the front or head end of the compactor ram 20 when the face plate 26 is positioned thereagainst within the guide frame 36. The hook 58 is normally biased into engagement with the bracket 42 by means of a tension spring 76 connected between a guide pin 60 fastened on the face plate 26 and a small aperture 62 on the lever arm 48 at a location proximate the latching hook 58. The tension spring 76 pulls the lever arm 48 in a clockwise rotation about its pivot point 50, and maintains the latching hook 58 in engagement with the bracket 42, thereby firmly fastening the face plate 26 to the front end of the compactor ram 20.

The upper conduit or pipe 30 on the face plate 26 is provided with a cutout or recess 64 into which there extends the lower end portion of the lever arm 48 when the hook 58 is in an engaged position with the bracket 42.

When the face plate 26 is to be released from the forward or head end of the compactor ram 20, an elongate rod member 70 is inserted through the conduit 30 by being passed through suitable bores 72 formed through the wall of the dumpster container 12 in axial alignment with the conduit 30, thereby causing the bottom portion of the pivot lever 48 to be pivoted upwardly and outwardly of the conduit 30 against the action of the tension spring 76. This will cause the hook or latch 58 to disengage from the bracket 42, thereby releasing the face plate 26 from the compactor ram 20. Concurrently, the face plate 26 is now held in position within the opening 18 of the dumpster container 12 by means of the rod member 70 passing through the through-bores 72 formed in the container 12, the recess portions 38 in the guide frame 36, and the conduit 30 of the face plate 26. Furthermore, in order to prevent pivoting of the face plate 26 about rod member 70 when arranged in the opening 18, a similar elongate rod member 70 may be passed through the lower bores 74 provided in the container 12 in axial alignment with recesses 40 in the guide frame 36, and also extending through the conduit 32 of the face plate 26. This will cause the face plate 26 to assume the position of a seal or closure over the opening 18 and will thereby prevent any trash or refuse from spilling out upon separation between the compactor 14 and the full dumpster container 12. The dumpster container 12 may then be moved to a location for emptying and, upon return, may be again positioned with its opening 18 against the compactor 14. The compactor ram 20 is moved into its forward position so that the guide frame 36 at the head end thereof will have the recesses 38 and 40 in axial alignment with the rods 70. The rods 70 are then drawn outwardly and removed, permitting the latch 58 to again move into engagement with the bracket 42 under the urging of the tension spring 76, and the face plate 26 again becomes the end surface at the head end of the compactor which, upon retraction of the compactor ram 20, will again permit the filling operation of the dumpster container 12 to commence from the hopper 24.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. In the combination of a storage bin having at least one opening for the inlet of material into said bin with a compactor communicating with said opening; hopper means for supplying solids material into said compactor; and compactor ram means reciprocable within said compactor for conveying the material from said compactor through said inlet opening into the storage bin; the improvement comprising: a face plate mounted on the forward end of said compactor ram and being adapted to enter said bin opening during the compacting stroke of said ram towards the bin, said face plate having peripheral dimensions in substantial conformance with the size of said bin inlet opening; latch means on said face plate normally engaging means on said compactor ram for releasably fastening said face plate to said compactor ram; resilient biasing means normally biasing said latch means into a latching position for fastening said face plate to the head end of said compactor ram; means engageable with said storage bin and said face plate when the latter is in a predetermined position within the bin opening for biasing said latch means into an unlatching position releasing said face plate from said compactor ram and concurrently locking said face plate to said storage bin to form a closure for said inlet opening; a guide frame fastened to the head end of said compactor ram circumferentially encompassing said face plate, said guide frame guiding said face plate into said latching engagement with the compactor ram, recesses formed in said guide frame in axial alignment with the latch means of said face plate; at least one conduit means on said face plate in axial alignment with said recesses and a through-bore in said storage bin axially aligned with said recesses and said latch means in the forward position of said compactor ram, said engaging means being insertable through said through-bore, recesses and conduit means to bias said latch means into a position for releasing said face plate from said compactor ram and locking said face plate to said storage bin.

2. The combination as claimed in claim 1, said engaging means comprising an elongate rod member extending through said through-bore, said recesses and said conduit means.

3. The combination as claimed in claim 1, comprising further recesses in said guide frame in parallel spaced relationship with said first recesses; a further through-bore in said storage bin in alignment with said further recesses and conduit means upon said face plate being located in the inlet opening towards the forward stroke of said compactor ram; and means adapted to extend through said further through-bore, further recesses and conduit means for fastening said face plate to said storage bin to prevent pivoting of said face plate within said inlet opening when said face plate is attached to said storage bin as a cover for said inlet opening.

4. The combination as claimed in claim 3, said extending means comprising an elongate rod member adapted to extend through said further through-bore, further recesses and conduit means.

5. The combination as claimed in claim 1, said resilient biasing means comprising a tension spring member.

6. The combination as claimed in claim 1, said face plate and said inlet opening being substantially rectangular in configuration and extending over a major portion of the width of said storage bin.

7. The combination as claimed in claim 1, said storage bin comprising a dumpster container.

8. The combination as claimed in claim 1, said compactor ram being hydraulically reciprocated.

* * * * *